US005984308A

United States Patent [19]

Herrmann

[11] Patent Number: 5,984,308

[45] Date of Patent: Nov. 16, 1999

[54] CARD GAME AND METHOD OF PLAY

[76] Inventor: Dolores Herrmann, P.O. Box 7531, Kirksville, Mo. 63501-7531

[21] Appl. No.: 09/061,601

[22] Filed: Apr. 16, 1998

[51] Int. Cl.[6] ..... A63F 1/00

[52] U.S. Cl. ..... 273/292

[58] Field of Search ..... 273/292, 309, 273/274; 463/12, 13

[56] References Cited

U.S. PATENT DOCUMENTS 5,636,843 6/1997 Roberts ..... 273/292
5,806,846 9/1998 Lofink et al. ..... 273/292
5,816,575 10/1998 Keller ..... 273/292
5,839,730 11/1998 Pike ..... 273/292

*Primary Examiner*—Benjamin H. Layno
*Attorney, Agent, or Firm*—Shook, Hardy & Bacon LLP

[57] ABSTRACT

A variation of the popular casino game of Blackjack makes provision for an optional bonus bet. If a bonus bet is made and the player making the bonus bet receives a matching pair in his initial two cards and elects to stand on the point count indicated by the sum of his two initial cards, he is awarded a bonus payment if the dealer breaks or fails to beat or tie the player's point count value. The bonus payment may be a multiple of the player's base bet, it may vary with the size of the pair, and it may be enhanced if the cards in the player's pair are in the same suit.

20 Claims, 2 Drawing Sheets

CARD GAME AND METHOD OF PLAY

FIELD OF THE INVENTION

This invention relates generally to card games and more particularly to a method of playing a wagering game which is an enhancement of the traditional game commonly known as "Blackjack" or "Twenty One".

BACKGROUND OF THE INVENTION

There have been several variations proposed for the popular casino card game known as Blackjack or Twenty One. Some of these variations have involved changes in the traditional rules of the game or changes in the content or type of cards that are used. Other proposals have allowed side bets and bonus bets of different kinds which essentially involve the availability of optional bets that can be made on the cards outside of the normal rules of the game. However, none of the proposals made to date has been particularly successfully, and the standard Blackjack game continues to dominate most casino card rooms.

SUMMARY OF THE INVENTION

The present invention is directed to a Blackjack variation which is intended to provoke increased interest in that the possibility of higher payoffs is available to the players. It is the primary goal of the invention to provide a method of playing cards which follows conventional Blackjack rules for the most part, but which also makes available an optional bonus bet which enhances the payout in the event of paired cards on the part of players making the bonus bet.

In accordance with the invention, a standard Blackjack layout is used except that an added bonus betting area is provided at each player position for accepting bonus wagers that are optional to the players. The game is played using standard Blackjack rules for players who do not make a bonus bet. If a player who has made a bonus bet receives a pair for his or her initial two cards, he or she has a chance for an enhanced payoff (ten times the amount of the base bet, for example). In this situation, the player can elect to draw additional cards, in which case the bonus bet is forfeited and the player continues to play using normal Blackjack rules and strategy.

Alternatively, the player can elect to stand with his initial pair and gamble that its point value will beat the dealer's point count calculated under normal rules. The dealer either stands or draws cards until he either breaks his hand or has to stand on a count value that is usually between 17 and 21. If the dealer beats a bonus player, the bonus player loses both his base bet and his bonus bet. However, if a bonus player beats the dealer, he is paid an enhanced amount which may be 10 times his base bet (plus the return of his bonus bet). The possibility of a win with an enhanced payment increases the excitement, amusement and versatility of the game and thus makes the game more interesting and enjoyable. At the same time, players who are not interested in making bonus bets can play using conventional Blackjack rules.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
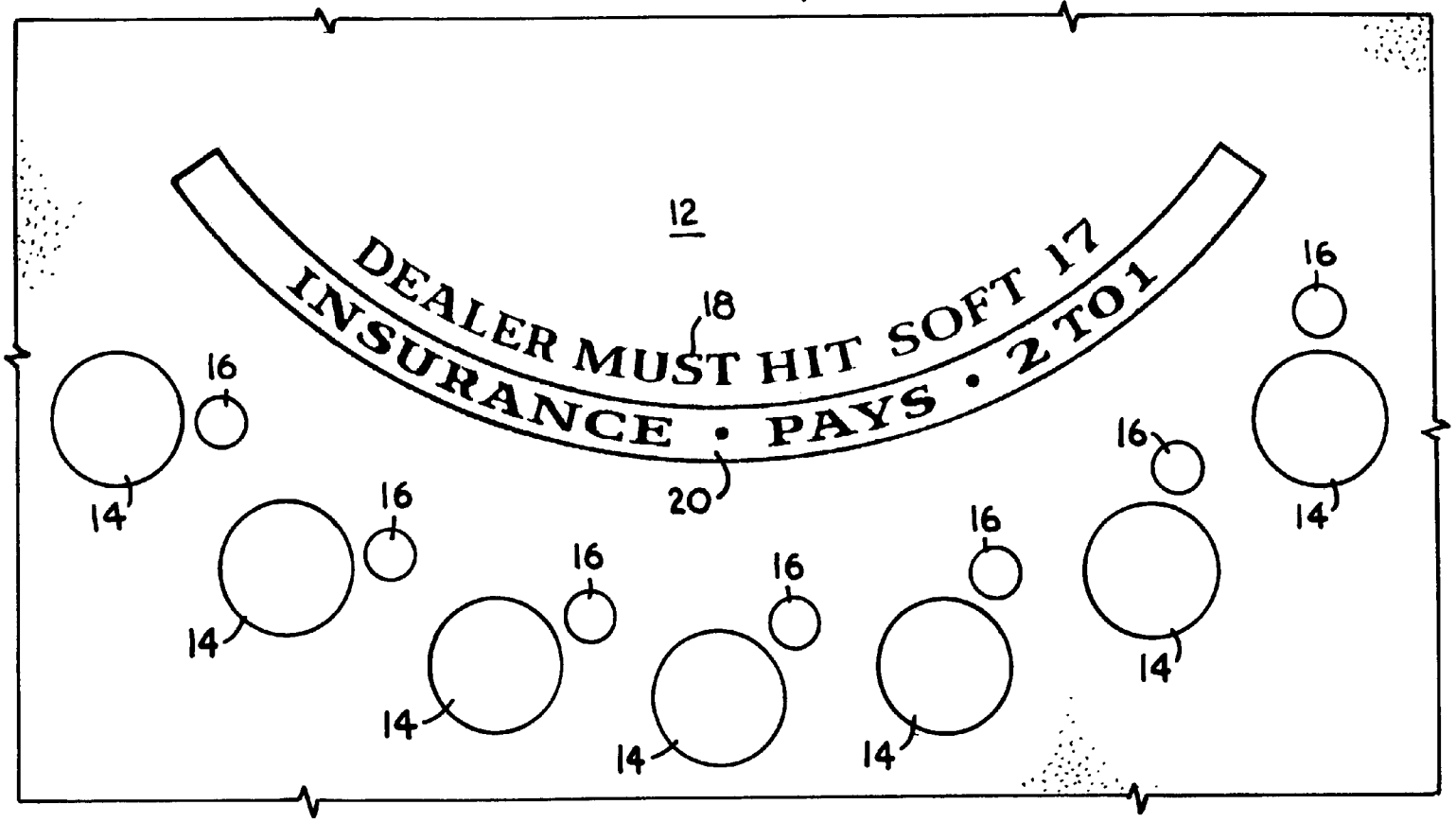
FIG. 1 is a diagrammatic plan view of a card playing surface which may be used for playing a card game in accordance with a preferred embodiment of the present invention.

Referring now to the drawing in more detail and initially to FIG. 1, numeral 10 generally designates a horizontal playing surface on which a card game may be played in accordance with the present invention. The playing surface 10 includes a dealer position or area 12 where the dealer's cards are distributed. A rack for holding gaming chips is normally provided adjacent to the dealer position 12 for storing chips. The surface 10 also usually includes a money slot (not shown) through which cash is dropped into a locked cash box when players purchase gaming chips.

On the side of the surface 10 opposite dealer area 12, the surface 10 includes a plurality of player positions, each of which has a wagering area 14 in which base player bets may be placed by players. The wagering areas 14 are depicted as being circular and being seven in number, although other shapes and numbers are possible. Associated with each of the base wagering areas 14 is a corresponding bonus wagering area 16 in which optional bonus wagers may be placed, as will be explained more fully. Each area 16 is smaller than the corresponding area 14 and may be large enough to receive a standard gaming chip.

Between the dealer position 12 and the player positions, the playing surface 10 may be imprinted with information materials such as general rules indicated at 18 and an optional insurance betting area 20.

Figure 2:
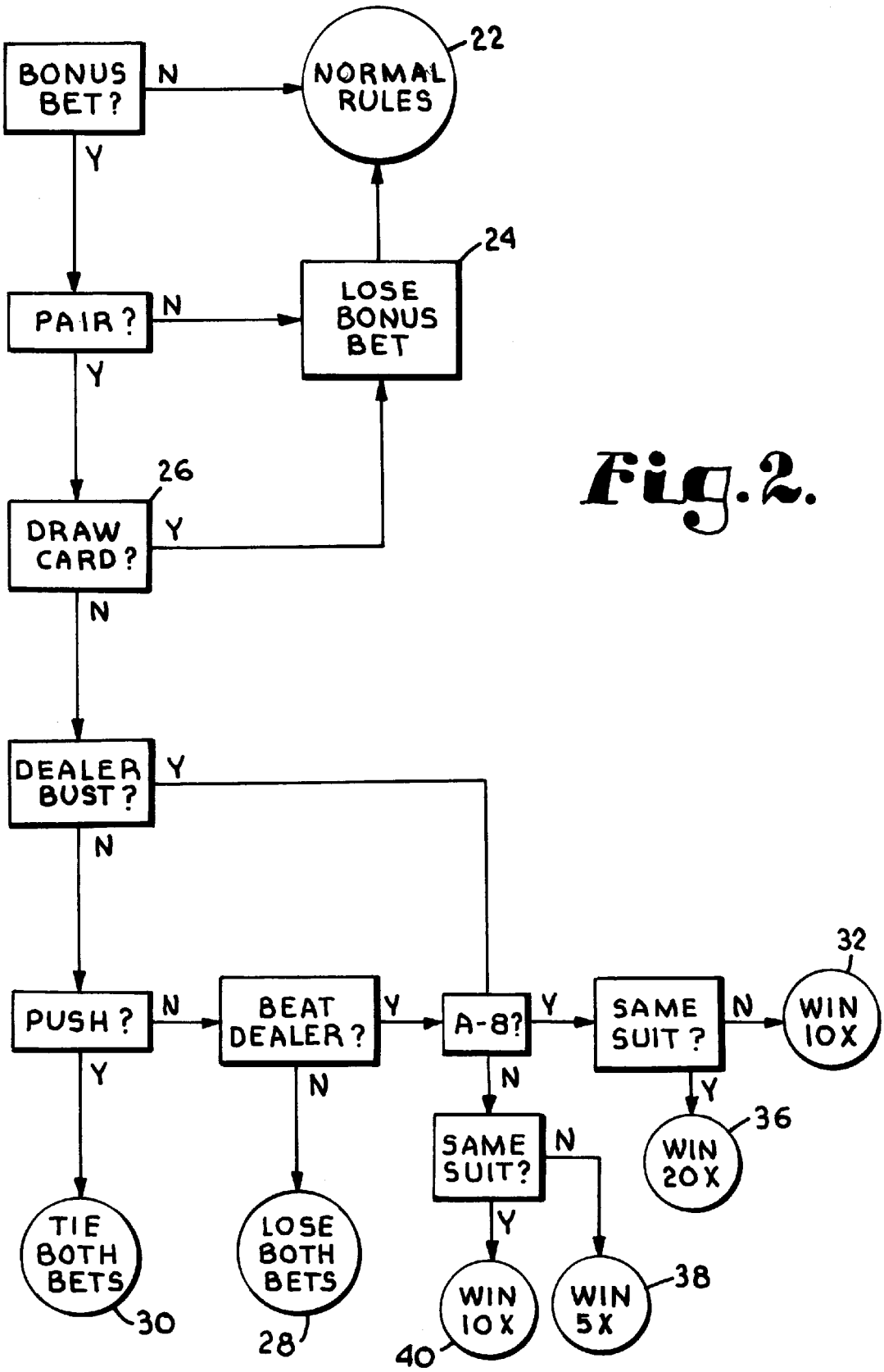
FIG. 2 is a flow chart for the play of the game.

In accordance with the present invention, the card game may be played on the surface 10 generally following conventional rules for "Blackjack" or "Twenty One" for the most part. Each player who desires to play may place a base player wager within his or her base wagering area 14. Each player who has placed a base wager within area 14 has the option of also placing a bonus wager (in the amount of one dollar, for example) in the bonus wagering area 16. If a player does not place a bonus wager in area 16, the game proceeds with respect to him under the normal house rules for Blackjack, as reflected by the "normal rules" area 22 in FIG. 2.

After all wagers have been placed, the dealer deals initial cards to all of the players and the dealer under conventional Blackjack practice. The cards are distributed one at a time beginning with the player positioned immediately to the left of the dealer and proceeding in a clockwise direction. The final card from the first round is distributed to the dealer position 12, and a second round of cards is then dealt in the same fashion, with each player receiving two initial cards and the dealer receiving two initial cards. One of the cards distributed to the dealer position 12 is exposed, and the other dealer card is unexposed and unknown to the players.

Standard playing cards may be used, and one or more decks may be included in the stack or "shoe" of cards that is dealt. The cards have the usual four suits and the usual numeric values. An ace may be considered as having a point count of either one or 11, cards designated 2–10 have a numeric value equal to their face value, and all face cards have a point value of 10, all in accordance with normal rules.

After the two initial cards are dealt to each player and to the dealer position 12, the players are given an option of being distributed additional cards in an attempt to obtain a total point value of all cards taken that exceeds the total point count of the dealer's cards without going over the normal upper limit value of 21. Players who have not made a bonus wager in area 16 play using normal Blackjack rules and strategy. Any player who has made a bonus bet in area 16 and whose initial two cards are not equal to one another in their numeric value is declared to have lost his bonus bet (Block 24 in FIG. 2). The dealer removes the wager made in area 16 for each position at which a losing bonus bet has been made, and that player thereafter follows standard Blackjack rules and strategy in drawing additional cards or standing. Any player who draws additional cards and reaches a sum value of all cards taken that exceeds the upper limit of 21 is declared a loser of the base bet. The dealer removes the base wager from area 14 for all players who "break" the upper limit of 21.

Players who have made a bonus bet in area 16 and who receive cards that are "paired" (equal in their numeric value) (Block 26) in his initial two cards has the option of either standing on his initial matched pair or drawing additional cards. If a bonus player position decides to draw cards in addition to his initial two cards, he is declared to have lost his bonus wager, and the dealer removes the bonus bet from area 16. The player then proceeds to play his cards under normal Blackjack rules and strategy.

If a player who has made a bonus bet receives matching cards in his initial two cards and decides to stand on his matching pair, no additional cards are distributed to that player position and the player qualifies for a possible enhanced payoff. It should be noted that in a preferred way of playing the game, non-matching face cards such as a King and Jack, for example, are not considered as being a pair even though each has a point value of 10. Likewise, a ten card and a King is not considered to be a pair under a preferred method of playing the game. Two Kings or two Jacks or two tens is a pair. However, the game can be played under rules providing for non-matching face cards to be considered a pair.

After all players have been distributed all additional cards that they elect to take, the dealer exposes the originally face-down or unexposed card in his initial two cards. If the dealer has initial cards which add up to a selected value (normally 17) or greater, the dealer stands on the point value of his initial two cards and is not distributed any additional cards. The sum value of the dealer's cards is then compared with the sum value of all of the cards dealt to each player. If the dealer's point count exceeds that of any player, the player is declared to have lost his base bet, and the dealer takes the base bet from area 14. Any player who loses his base bet is also declared to have lost any bonus wager he has made in area 16, and the dealer then removes the bonus bet at the same time as the base bet (block 28). If the sum value of all cards taken by a player exceeds the sum value of the dealer's cards, the player is declared to be a winner, and the dealer pays him the amount wagered in the base wagering area 14 if there is no bonus bet remaining in area 16. Any player who has made a bonus bet in area 16, and who has stayed on an initial pair, and whose point value exceeds that of the dealer is declared to be a bonus bet winner. The player is awarded an enhanced payment under rules that will be explained.

If the dealer has a total point count on his initial two cards that amounts to less than the established selected value (usually 17), he must distribute one or more additional cards to the dealer position until the sum value of his cards reaches or exceeds the selected value. If the dealer draws additional cards and reaches a point count that exceeds the upper limit of 21, his hand is declared to be a breaking hand, and all players who have not previously had breaking hands themselves are declared to be base bet winners. The dealer then pays each player who is still in the game an amount equal to the amount wagered in the base wagering area 14 if there is no bonus bet remaining in area 16. In this situation, a player who has made a bonus bet and who has elected to stand on an initial pair is declared to be a bonus bet winner, and he is awarded an enhanced bonus bet payment.

If the dealer draws additional cards beyond his initial two cards and reaches a total point count value that is in the range of 17–21, the dealer cannot draw additional cards and the card distribution is complete. The dealer then compares his total point count value with the total point count value of all of the cards at each player position. If the point count of the dealer exceeds that of any player position, that player is declared to be a base bet loser, and the dealer takes the base bet that was wagered in area 14. In addition, any bonus bet that remains in area 16 is declared to be a losing bet under these circumstances, and the dealer takes the bonus bet at the same time as the base bet.

Any player whose total point count value exceeds that of the dealer is declared to be a base bet winner, and the dealer matches the wager made in area 14 if there is no bonus bet remaining in area 16. Again, any player who also has a bonus bet remaining in area 16 (a player who made an initial bonus bet and stayed on an initial pair) is declared to be a bonus bet winner and is awarded an enhanced payment.

If the total point count of the dealer is equal to the total point count of any player, a "push" or tie is declared. The base bet made by the player in wagering area 14 is neither taken by the dealer nor matched by the dealer in a tie situation. Likewise, when a tie is declared for any player who has made a bonus bet in area 16, the player's bonus bet is considered to be a tie along with the base bet in area 14 (block 30).

The amount by which any winning bonus bet is enhanced can vary. By way of example, in one form of the game, the amount of the enhancement can be a multiple of the amount of the base bet wager. Thus, the bonus award may be five times the base bet or ten times the base bet. It is also contemplated that the multiple that is used can vary depending upon the point value of the pair that the bonus bettor is dealt in his initial cards. For example, if the pair consists of relatively low cards (such as aces through eights), the multiple that is used may be larger than the multiple used for paying higher pairs (such as nine–King). As an example, a pair of aces–eights may be paid ten times the amount of the base wager in area 14 (block 32), while a higher pair (nines–Kings) may be paid at an amount equal to five times the base bet in area 14 (block 34). In any case, the bonus wager in area 16 is returned to the winning bonus better in addition to the bonus payout made based on the amount in the base wagering area 14.

Another option is to further enhance the payout to winning bonus bettors if the cards in their initial pair are of the same suit. For example, if both cards in the pair are spades, the player may be paid twice what he would otherwise be paid for a non-suited pair. Thus, if a player has two spade eights in his initial pair and wins his bonus bet, he would be paid his normal payout of ten times his base bet for having the pair and winning, and this amount would be doubled (to a total of twenty times the base bet) by reason of the pair being in the same suit (block 36). A winning bonus bet having a pair of heart Queens would be paid the normal amount of five times the base bet, and that would be doubled to ten times the base bet because the pair are in the same suit (block 40).

It should be noted that standard Blackjack rules relating to insurance, splitting cards, doubling down, enhanced payment for two card Twenty One, and treatment of dealer hitting or standing on a "soft 17" are normally followed in the play of the game. It should also be noted that although the game has been described in connection with the dealing of actual cards, it is equally applicable to electronic versions of Blackjack such as video Blackjack and Blackjack otherwise played using electronic or other media.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. A method of playing a wagering game in which cards each having a numeric value are distributed to at least one player position for which a player bet is made and to a dealer position, said method comprising the steps of:

(a) providing for a bonus bet to be made for each player position;

(b) distributing initial player cards comprising two cards to each player position and initial dealer cards comprising two cards to the dealer position;

(c) allowing each player position the option of being distributed additional cards;

(d) following prescribed rules to determine how many additional cards, if any, are distributed to the dealer position;

(e) comparing the sum value of all cards distributed to each player position with the sum value of all cards distributed to the dealer position;

(f) using prescribed rules and the comparison of step (e) to declare a player bet win or loss for each player position;

(g) declaring a bonus bet win for each player position only for which a player bet win is declared and for which there is a bonus bet made and the initial player cards are equal in value; and (h) awarding a bonus payment based on the amount of the player bet for each player position only for which a bonus bet win is declared.

2. A method as set forth in claim 1, including the step of varying the amount of said bonus payment depending upon the value of the initial player cards for each player position for which a bonus bet win is declared.

3. A method as set forth in claim 2, wherein the cards have a plurality of suit designations and including the step of enhancing the amount of said bonus payment when the initial player cards are matching in suit designation for each player position for which a bonus bet win is declared.

4. A method as set forth in claim 1, wherein the cards have a plurality of suit designations and including the step of enhancing the amount of said bonus payment when the initial player cards are matching in suit designation for each player position for which a bonus bet win is declared.

5. A method as set forth in claim 1, including the step of declaring a bonus bet loss for each player position for which additional cards are distributed under step (c).

6. A method as set forth in claim 1, including the steps of:

establishing a preselected value as an upper limit for the sum value of all cards distributed to any player position and to the dealer position; and declaring a player bet loss for each player position for which the sum total of all cards distributed exceeds said preselected value.

7. A method as set forth in claim 6, including the step of declaring a player bet win for each player position if:

there is not a player bet loss declared for the player position by reason of the sum total of all cards distributed there having exceeded said preselected value; and the sum total of all cards distributed to the dealer position exceeds said preselected value.

8. A method of playing a wagering game in which cards each having a numeric value are distributed to at least one player position for which a player bet is made and to a dealer position, said method comprising the steps of:

(a) providing each player position with the option of making a bonus bet;

(b) distributing initial player cards comprising two cards to each player position and initial dealer cards comprising two cards to the dealer position;

(c) declaring a bonus bet loss for each player position for which a bonus bet is made and the initial player cards are not equal in value;

(d) providing each player position with the option of being distributed at least one additional card;

(e) declaring a bonus bet loss for each player position for which a bonus bet is made and to which any additional card is distributed;

(f) following prescribed rules for distributing additional cards, if any, to the dealer position;

(g) comparing the sum value of all cards distributed to each player position with the sum value of all cards distributed to the dealer position;

(h) declaring a player bet win or loss for each player position using prescribed rules based on the comparison of step (g);

(i) declaring a bonus bet win or loss based on the comparison of step (g) and using prescribed rules for each player position for which a bonus bet is made and for which there is not a bonus bet loss declaration under step (c) or step (e); and (j) awarding a bonus payment greater than the amount of the player bet for each player position for which a bonus bet win is declared.

9. A method as set forth in claim 8, including the step of varying the amount of said bonus payment depending upon the value of the initial player cards for each player position for which a bonus bet win is declared.

10. A method as set forth in claim 9, wherein the cards have a plurality of suit designations and including the step of enhancing the amount of said bonus payment when the initial player cards are matching in suit designation for each player position for which a bonus bet win is declared.

11. A method as set forth in claim 8, wherein the cards have a plurality of suit designations and including the step of enhancing the amount of said bonus payment when the initial player cards are matching in suit designation for each player position for which a bonus bet win is declared.

12. A method as set forth in claim 8, wherein the amount of said bonus payment is a predetermined multiple of the amount of the player bet for each player position for which a bonus bet win is declared.

13. A method as set forth in claim 12, wherein said multiple is variable depending upon the value of the initial player cards for each player position for which a bonus bet win is declared.

14. A method as set forth in claim 12, wherein:

the cards have a plurality of suit designations; and said multiple is enhanced when the initial player cards are matching in suit designation for each player position for which a bonus bet win is declared.

15. A method as set forth in claim 8, including the steps of establishing a preselected value as an upper limit for the sum value of all cards distributed to any player position and to the dealer position; and declaring a player bet loss for each player position for which the sum total of all cards distributed exceeds said preselected value.

16. A method as set forth in claim 15, including the step of declaring a player bet win if:

there is not a player bet loss declared for the player position by reason of the sum total of all cards distributed there having exceeded said preselected value; and the sum total of all cards distributed to the dealer position exceeds said preselected value.

17. A method of playing a wagering game wherein cards each having a numeric value are distributed to at least one player position for which a player bet is made and to a dealer position wherein an upper limit value is established for the sum value of all cards distributed to any position and wherein a selected value less than said limit value is established, said method comprising the steps of:

(a) providing for a bonus bet to be made for each player position;

(b) distributing initial player cards comprising two cards to each player position and initial dealer cards comprising two cards to the dealer position;

(c) declaring a bonus bet loss for each player position for which a bonus bet is made and the initial player cards are not equal in value;

(d) providing each player position with the option of being distributed at least one additional card;

(e) declaring a bonus bet loss for each player position for which a bonus bet is made and to which any additional card is distributed;

(f) declaring a player bet loss for each player position for which the sum value of said initial cards and any additional cards exceeds said limit value;

(g) if the sum value of said initial dealer cards equals or exceeds said selected value, comparing the sum value of the initial dealer cards with the sum value of all cards distributed to each player position for which a player bet loss has not been declared under step (f);

(h) declaring a player bet loss for each player position for which the comparison of step (g) indicates that the sum value of the initial dealer cards exceeds the sum value of all cards distributed to the player position;

(i) declaring a player bet win for each player position for which the comparison of step (g) indicates that the sum value of all cards distributed to the player position exceeds the sum value of the initial dealer cards;

(j) if said selected value exceeds the sum value of said initial dealer cards, distributing additional cards to the dealer position until the sum value of all cards distributed to the dealer position at least equals said selected value;

(k) if the sum value of all cards distributed to the dealer position at the end of step (j) exceeds said limit value, declaring a player bet win for each player position for which a player bet loss is not declared under step (f);

(l) if the sum value of all cards distributed to the dealer position at the end of step (j) is at or above said selected value and at or below said limit value, comparing the sum value of all cards distributed to the dealer position with the sum value of all cards distributed to each player position for which a player bet loss has not been declared under step (f);

(m) declaring a player bet loss for each player position for which the comparison of step (l) indicates not the sum value of all cards distributed to the dealer position exceeds the sum value of all cards distributed to the player position;

(n) declaring a player bet win for each player position for which the comparison of step (e) indicates that the sum value of all cards distributed to the player position exceeds the sum value of all cards distributed to the dealer position;

(o) declaring a bonus bet win for each player bet position for which a bonus bet is made and a bonus bet loss has not been declared and for which a player bet win is declared; and (p) awarding a bonus payment based on and greater than the amount of the player bet or each player position for which a bonus bet win is declared.

18. A method as set forth in claim 17, including the steps of:

declaring a player bet tie for each player position for which the comparison of step (g) or the comparison of step (l) indicates that the sum value of all cards distributed to the dealer equals the sum value of all cards distributed to the player position; and declaring a bonus bet tie for each player position for which a player bet tie is declared and a bonus bet loss has not been declared.

19. A method as set forth in claim 17, including the step of varying the amount of said bonus payment depending upon the value of the initial player cards for each player position for which a bonus bet win is declared.

20. A method as set forth in claim 17, wherein the cards have a plurality of suit designations and including the step of enhancing the amount of said bonus payment when the initial player cards are matching in suit designation for each player position for which a bonus bet win is declared.

* * * * *